US007404277B2

(12) United States Patent
Schach et al.

(10) Patent No.: US 7,404,277 B2
(45) **Date of Patent: *Jul. 29, 2008**

(54) BEVERAGE BOTTLING PLANT FOR FILLING BOTTLES WITH A LIQUID BEVERAGE FILLING MATERIAL HAVING AN INFORMATION ADDING STATION

(75) Inventors: Martin Schach, Bochum (DE); Klaus Krämer, Dortmund (DE)

(73) Assignee: KHS Maschinen- und Anlagenbau AG, Dortmund (DE)

( * ) Notice: Subject to any disclaimer, the term of this patent is extended or adjusted under 35 U.S.C. 154(b) by 0 days.

This patent is subject to a terminal disclaimer.

(21) Appl. No.: 11/677,274

(22) Filed: Feb. 21, 2007

(65) Prior Publication Data

US 2007/0193223 A1 Aug. 23, 2007

(30) Foreign Application Priority Data

Feb. 21, 2006 (DE) ..... 20 2006 002 729 U

(51) Int. Cl.
*B65C 9/02* (2006.01)
*B65B 61/00* (2006.01)
*B67C 7/00* (2006.01)

(52) U.S. Cl. ..... 53/136.1; 53/167; 53/281; 156/DIG. 12; 156/DIG. 25

(58) Field of Classification Search ..... 53/136.1, 53/167, 281, 284.5; 156/DIG. 12, DIG. 13, 156/DIG. 25, DIG. 26
See application file for complete search history.

(56) References Cited

U.S. PATENT DOCUMENTS

| | | | | |
|---|---|---|---|---|
| 2,657,816 | A * | 11/1953 | Everett | 156/DIG. 12 |
| 2,826,022 | A * | 3/1958 | Austin | 53/136.1 |
| 7,060,143 | B1 * | 6/2006 | Eiban et al. | 156/DIG. 12 |
| 7,182,115 | B2 * | 2/2007 | Sindermann et al. | 156/363 |
| 2004/0099379 | A1 * | 5/2004 | Erich | 156/567 |
| 2005/0034423 | A1 * | 2/2005 | Sindermann et al. | 53/136.1 |
| 2005/0284103 | A1 * | 12/2005 | Hartness et al. | 53/136.1 |
| 2007/0193223 | A1 * | 8/2007 | Schach et al. | 53/167 |
| 2007/0204563 | A1 * | 9/2007 | Kramer et al. | 53/167 |

* cited by examiner

*Primary Examiner*—Stephen F. Gerrity
(74) *Attorney, Agent, or Firm*—Nils H. Ljungman & Associates

(57) ABSTRACT

Beverage bottling plant for filling bottles with a liquid beverage filling material having an information adding station.

20 Claims, 5 Drawing Sheets

BEVERAGE BOTTLING PLANT FOR FILLING BOTTLES WITH A LIQUID BEVERAGE FILLING MATERIAL HAVING AN INFORMATION ADDING STATION

BACKGROUND

1. Technical Field

This application relates to a beverage bottling plant for filling bottles with a liquid beverage filling material having an information adding station.

2. Background Information

A beverage bottling plant for filling bottles with a liquid beverage filling material can possibly comprise a beverage filling machine, which is often a rotary filling machine, with a plurality of beverage filling positions, each beverage filling position having a beverage filling device for filling bottles with liquid beverage filling material. The filling devices may have an apparatus designed to introduce a predetermined volume of liquid beverage filling material into the interior of bottles to a substantially predetermined level of liquid beverage filling material.

Some beverage bottling plants may possibly comprise filling arrangements that receive a liquid beverage material from a toroidal or annular vessel, in which a supply of liquid beverage material is stored under pressure by a gas. The toroidal vessel may also be connected to at least one external reservoir or supply of liquid beverage material by a conduit or supply line. In some circumstances it may even be possible that a beverage bottling plant has two external supply reservoirs, each of which may be configured to store either the same liquid beverage product or different products. These reservoirs could possibly be connected to the toroidal or annular vessel by corresponding supply lines, conduits, or other arrangements. It is also possible that the external supply reservoirs could be in the form of simple storage tanks, or in the form of liquid beverage product mixers.

A wide variety of types of filling elements are used in filling machines in beverage bottling or container filling plants for dispensing a liquid product into bottles, cans or similar containers, including but not limited to filling processes that are carried out under counterpressure for the bottling of carbonated beverages. The apparatus designed to introduce a predetermined flow of liquid beverage filling material further comprises an apparatus that is designed to terminate the filling of the beverage bottles upon the liquid beverage filling material reaching the predetermined level in bottles. There may also be provided a conveyer arrangement that is designed to move bottles, for example, from an inspecting machine to the filling machine.

After a filling process has been completed, the filled beverage bottles are transported or conveyed to a closing machine, which is often a rotary closing machine. A revolving or rotary machine comprises a rotor, which revolves around a central, vertical machine axis. There may further be provided a conveyer arrangement configured to transfer filled bottles from the filling machine to the closing station. A transporting or conveying arrangement can utilize transport star wheels as well as linear conveyors. A closing machine closes bottles by applying a closure, such as a screw-top cap or a bottle cork, to a corresponding bottle mouth. Closed bottles are then usually conveyed to an information adding arrangement, wherein information, such as a product name or a manufacturer's information or logo, is applied to a bottle. A closing station and information adding arrangement may be connected by a corresponding conveyer arrangement. Bottles are then sorted and packaged for shipment out of the plant.

Many beverage bottling plants may also possibly comprise a rinsing arrangement or rinsing station to which new, non-return and/or even return bottles are fed, prior to being filled, by a conveyer arrangement, which can be a linear conveyor or a combination of a linear conveyor and a starwheel. Downstream of the rinsing arrangement or rinsing station, in the direction of travel, rinsed bottles are then transported to the beverage filling machine by a second conveyer arrangement that is formed, for example, by one or more starwheels that introduce bottles into the beverage filling machine.

It is a further possibility that a beverage bottling plant for filling bottles with a liquid beverage filling material can be controlled by a central control arrangement, which could be, for example, a computerized control system that monitors and controls the operation of the various stations and mechanisms of the beverage bottling plant.

A machine for the equipment of bottles or like containers is known in the form of a rotating labeling machine (German Patent No. 202 21 208 UI) in which a plurality of labeling units are arranged in a free-standing manner, i.e., standing with their own feet on a base, on the periphery of a rotor driven to rotate about a vertical machine axis. In order to attain the necessary alignment of the free-standing labeling units with reference to the machine frame for the proper application of the equipment elements or labels onto the bottles or containers, additional elements are provided on the periphery of the machine frame for establishing the position of the respective labeling unit relative to the machine frame.

The basic advantage of such a machine is comprised in that, by exchanging one or a plurality of labeling units, it is possible, with no problem and without expending a great deal of time, to convert the machine from one container type or size to another container type or size, and/or from one equipment feature to another equipment feature, in particular also to perform calibration or adjustment tasks and/or repairs on the labeling units separately from the machine, and thus without interrupting production. However, one disadvantage of the known machine is comprised in that because of the free-standing arrangement of the labeling unit on the periphery of the machine frame, height adjustment or alignment, inter alia, is required for each unit.

OBJECT OR OBJECTS

An object of at least one possible embodiment of the present application is to provide a machine for the equipment of bottles or like containers, which machine retains the advantage of interchangeable labeling units while permitting simplified docking of the units to the machine.

SUMMARY

At least one possible embodiment of the present application is a machine for the equipment of bottles or like containers, having at least one transport element on a machine frame for moving said containers on a transport segment, as well as at least one labeling unit arranged on said transport segment, wherein said at least one labeling unit on a side adjacent to said machine frame having at least one unit-side centering and docking unit is supported in a load-transferring manner on at least one machine-side centering and docking unit.

In at least one possible embodiment of the present application, each labeling unit is supported on its side facing the machine or the machine frame with at least one unit-side centering and docking unit on at least one machine-side centering and docking unit. These centering and docking units, when cooperating, form not only a load-transferring support bearing for this support, but also at the same time effect the required alignment of the respective labeling unit with regard to the machine frame. In at least one possible embodiment of the present application, after the docking, at least on the side facing the machine frame, there is automatically the required height adjustment and/or the required alignment of the center axis EA to the machine frame 8 and/or the inclination and/or rotary position about the center axis EA or an axis of the respective labeling unit, which axis is parallel thereto.

In at least one possible embodiment of the present application, the support-bearing that is formed by at least one machine-side centering and docking unit and by the at least one unit-side centering and docking unit such that it enables a pivot movement about a horizontal or nearly horizontal axis, and specifically for adjusting the inclination of the labeling unit relative to the horizontal. For this, the labeling unit is supported on the base via at least one foot that is height-adjustable. This pivot movement option for adjusting the inclination is attained for example in that the at least one machine-side and/or unit-side centering and docking unit forms, at the at least one unit-side and/or machine-side centering and docking unit, a positioning or support surface for a countersurface, which (positioning or support surface) is arched or convexly curved about at least one axis parallel to the pivot axis.

At least one possible embodiment of the present application also has the advantage of a simple, rapid exchange of the labeling units, for instance for converting the machine to a different type and/or size of container, to a different type of equipment, etc.

Developments of at least one possible embodiment of the present application are described herein.

The above-discussed embodiments of the present invention will be described further hereinbelow. When the word "invention" or "embodiment of the invention" is used in this specification, the word "invention" or "embodiment of the invention" includes "inventions" or "embodiments of the invention", that is the plural of "invention" or "embodiment of the invention". By stating "invention" or "embodiment of the invention", the Applicant does not in any way admit that the present application does not include more than one patentably and non-obviously distinct invention, and maintains that this application may include more than one patentably and non-obviously distinct invention. The Applicant hereby asserts that the disclosure of this application may include more than one invention, and, in the event that there is more than one invention, that these inventions may be patentable and non-obvious one with respect to the other.

BRIEF DESCRIPTION OF THE DRAWINGS

At least one possible embodiment of the present application is explained in greater detail below illustrated in the accompanying drawings, in which.

DESCRIPTION OF EMBODIMENT OR EMBODIMENTS

Figure 1:
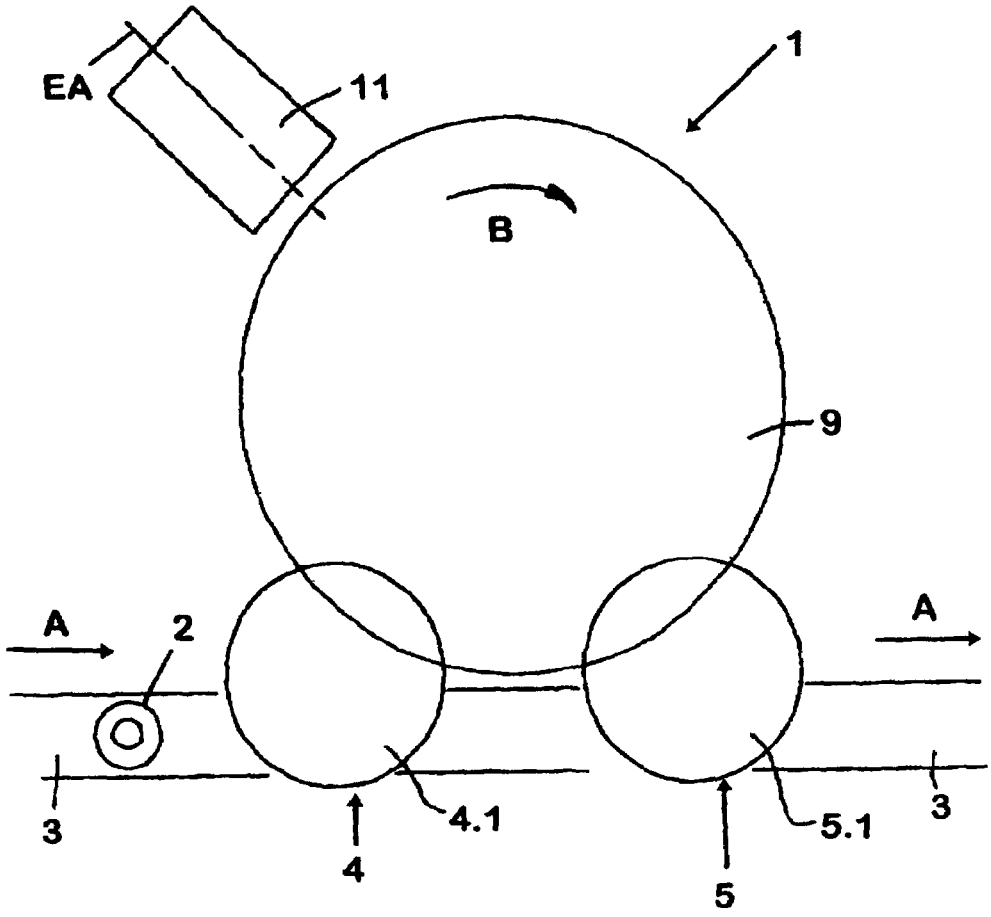
FIG. 1 is a simplified representation onto a top view of a machine for the equipment of bottles or like containers in the form of a rotating labeling machine.
Figure 1A:
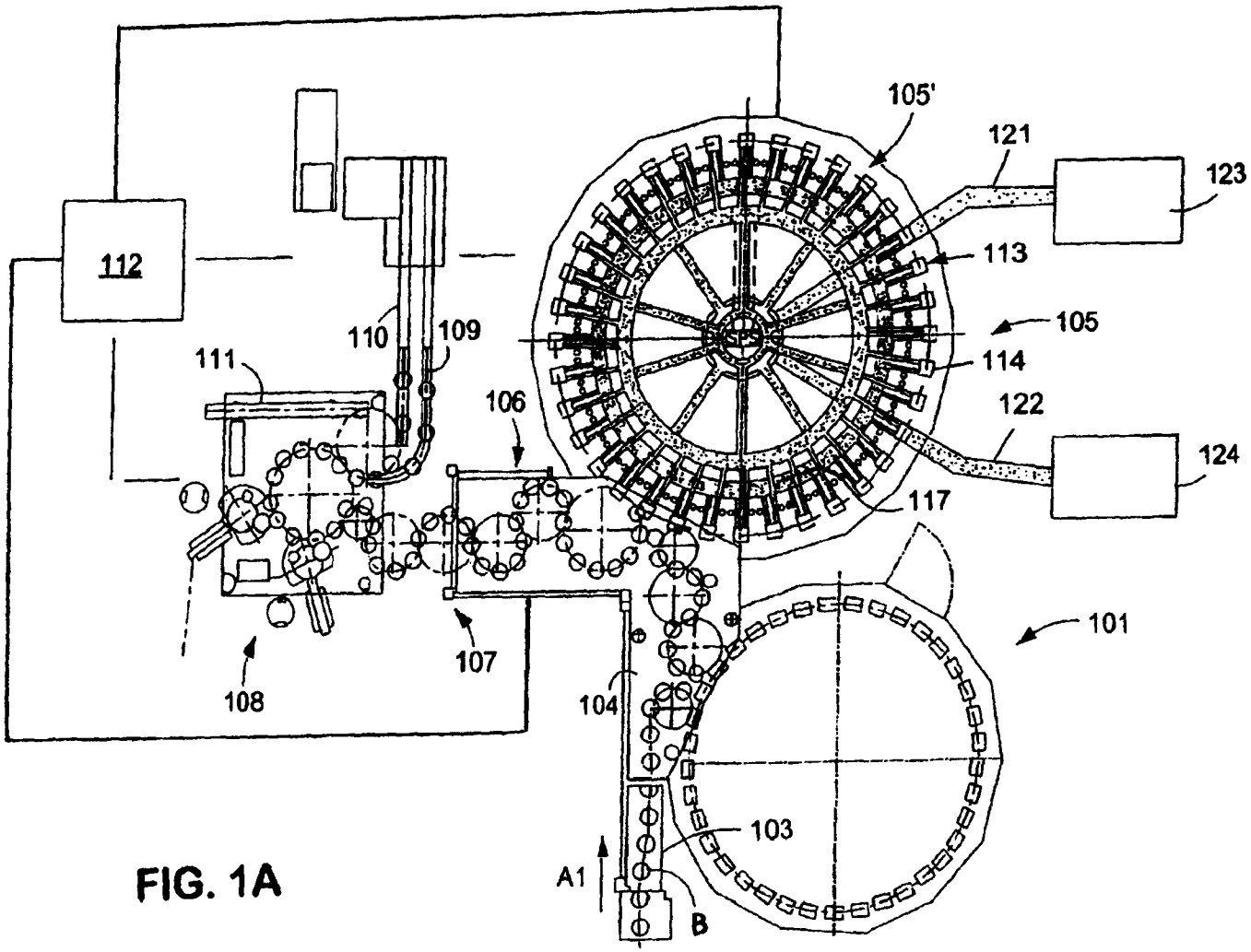
FIG. 1A shows schematically the main components of one possible embodiment example of a system for filling containers.

FIG. 1A shows schematically the main components of one possible embodiment example of a system for filling containers, specifically, a beverage bottling plant for filling bottles B with at least one liquid beverage, in accordance with at least one possible embodiment, in which system or plant could possibly be utilized at least one aspect, or several aspects, of the embodiments disclosed herein.

FIG. 1A shows a rinsing arrangement or rinsing station 101, to which the containers, namely bottles B, are fed in the direction of travel as indicated by the arrow A1, by a first conveyer arrangement 103, which can be a linear conveyor or a combination of a linear conveyor and a starwheel. Downstream of the rinsing arrangement or rinsing station 101, in the direction of travel as indicated by the arrow A1, the rinsed bottles B are transported to a beverage filling machine 105 by a second conveyer arrangement 104 that is formed, for example, by one or more starwheels that introduce bottles B into the beverage filling machine 105.

The beverage filling machine 105 shown is of a revolving or rotary design, with a rotor 105', which revolves around a central, vertical machine axis. The rotor 105' is designed to receive and hold the bottles B for filling at a plurality of filling positions 113 located about the periphery of the rotor 105'. At each of the filling positions 103 is located a filling arrangement 114 having at least one filling device, element, apparatus, or valve. The filling arrangements 114 are designed to introduce a predetermined volume or amount of liquid beverage into the interior of the bottles B to a predetermined or desired level.

The filling arrangements 114 receive the liquid beverage material from a toroidal or annular vessel 117, in which a supply of liquid beverage material is stored under pressure by a gas. The toroidal vessel 117 is a component, for example, of the revolving rotor 105'. The toroidal vessel 117 can be connected by means of a rotary coupling or a coupling that permits rotation. The toroidal vessel 117 is also connected to at least one external reservoir or supply of liquid beverage material by a conduit or supply line. In the embodiment shown in FIG. 1A, there are two external supply reservoirs 123 and 124, each of which is configured to store either the same liquid beverage product or different products. These reservoirs 123, 124 are connected to the toroidal or annular vessel 117 by corresponding supply lines, conduits, or arrangements 121 and 122. The external supply reservoirs 123, 124 could be in the form of simple storage tanks, or in the form of liquid beverage product mixers, in at least one possible embodiment.

As well as the more typical filling machines having one toroidal vessel, it is possible that in at least one possible embodiment there could be a second toroidal or annular vessel which contains a second product. In this case, each filling arrangement 114 could be connected by separate connections to each of the two toroidal vessels and have two individually-controllable fluid or control valves, so that in each bottle B, the first product or the second product can be filled by means of an appropriate control of the filling product or fluid valves.

Downstream of the beverage filling machine 105, in the direction of travel of the bottles B, there can be a beverage bottle closing arrangement or closing station 106 which closes or caps the bottles B. The beverage bottle closing arrangement or closing station 106 can be connected by a third conveyer arrangement 107 to a beverage bottle labeling arrangement or labeling station 108. The third conveyor arrangement may be formed, for example, by a plurality of starwheels, or may also include a linear conveyor device.

In the illustrated embodiment, the beverage bottle labeling arrangement or labeling station 108 has at least one labeling unit, device, or module, for applying labels to bottles B. In the embodiment shown, the labeling arrangement 108 is connected by a starwheel conveyer structure to three output conveyer arrangements: a first output conveyer arrangement 109, a second output conveyer arrangement 110, and a third output conveyer arrangement 111, all of which convey filled, closed, and labeled bottles B to different locations.

The first output conveyer arrangement 109, in the embodiment shown, is designed to convey bottles B that are filled with a first type of liquid beverage supplied by, for example, the supply reservoir 123. The second output conveyer arrangement 110, in the embodiment shown, is designed to convey bottles B that are filled with a second type of liquid beverage supplied by, for example, the supply reservoir 124. The third output conveyer arrangement 111, in the embodiment shown, is designed to convey incorrectly labeled bottles B. To further explain, the labeling arrangement 108 can comprise at least one beverage bottle inspection or monitoring device that inspects or monitors the location of labels on the bottles B to determine if the labels have been correctly placed or aligned on the bottles B. The third output conveyer arrangement 111 removes any bottles B which have been incorrectly labeled as determined by the inspecting device.

The beverage bottling plant can be controlled by a central control arrangement 112, which could be, for example, computerized control system that monitors and controls the operation of the various stations and mechanisms of the beverage bottling plant.

FIG. 1 shows a top view of a machine for the equipment of bottles or like containers in the form of a rotating labeling machine. In the figures, reference numeral 1 indicates a labeling machine which provides equipments, i.e. labels bottles 2 that are supplied, standing upright, i.e. with their bottle axis oriented or substantially oriented in the vertical direction, via a conveyor 3 to a container inlet 4 or an input or transfer star 4.1 there. After labeling, the bottles 2 are transferred to a container outlet 5 or, using an outlet or transfer star 5.1 there, back to a conveyor 3, and are supplied standing upright to another use.

Figure 2:
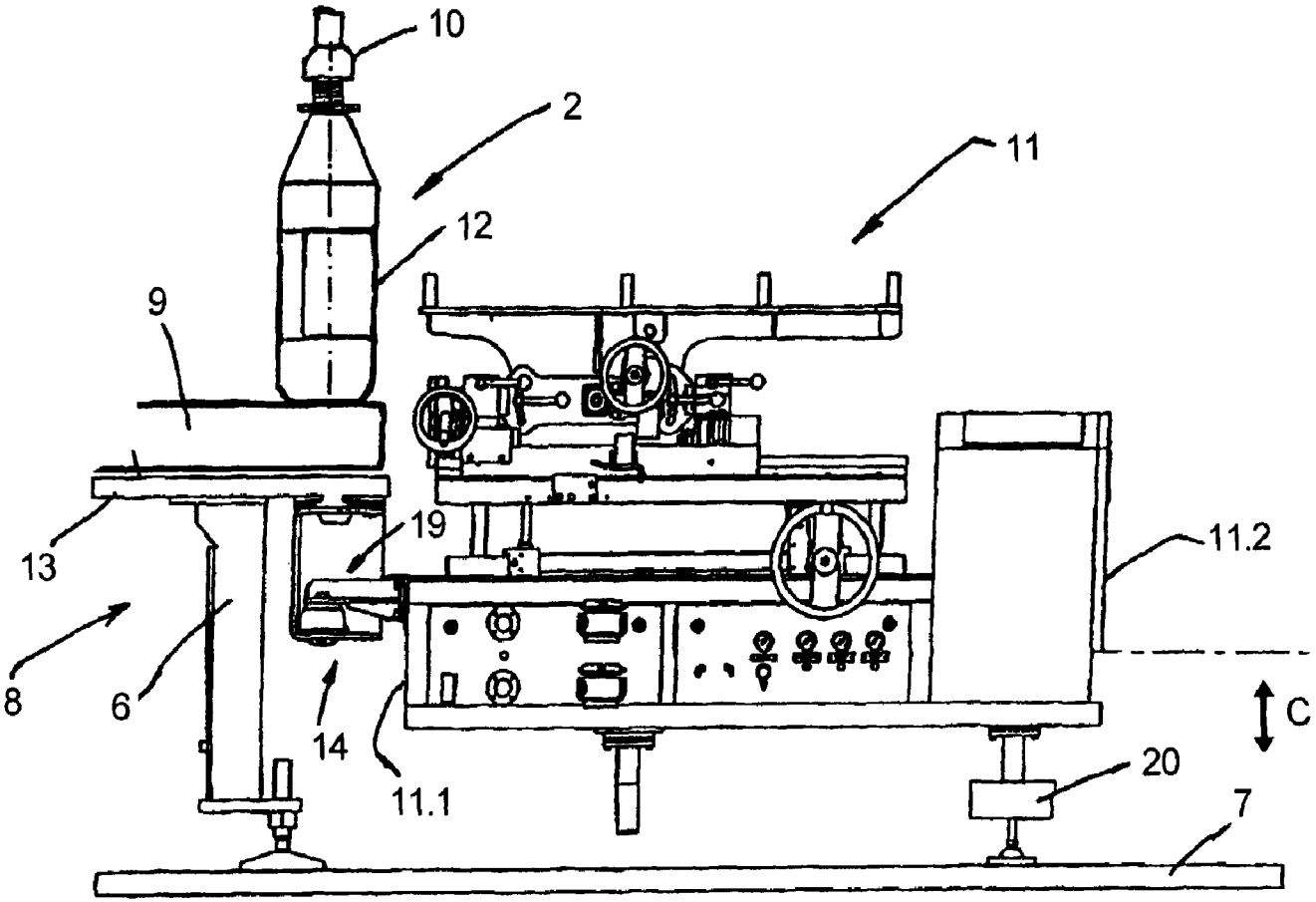
FIG. 2 is a side elevation of one of the interchangeable labeling stations docked to the machine structure or frame, together with a partial representation of the machine table and the rotor of the labeling machine, which rotor is driven about a vertical machine axis.

FIG. 2 shows at least one possible embodiment of one of the interchangeable labeling stations docked to the machine structure or frame, together with a partial representation of the machine table and the rotor of the labeling machine, which rotor is driven about a vertical machine axis. Described in greater detail, the labeling machine 1 has a rotating design such that i.e. it possesses inter alia a rotor 9 that is driven about a vertical machine axis in the direction of the arrow B and that stands on a machine frame 8 with a plurality of feet 6 on a floor or base 7 and on the circumference of which a plurality of standing surfaces are formed in a manner known to one skilled in the art to which the bottles 2 are individually transferred at the container inlet 4 and on which the bottles 2 during the labeling process are held using a stamp 10 provided over each standing surface by clamping between this stamp and the standing surface.

In at least one possible embodiment of the present application, provided on the periphery of the rotor 9 are a plurality of labeling stations or units 11, only one of which is shown in the figures for the sake of simplicity. The labeling units 11, which have all the functional elements necessary for affixing labels 12 to the bottles 2, are provided such that they do not rotate with the rotor 9 on the periphery of the machine frame 8, and specifically are interchangeable so that the labeling machine 1 can be converted with no problem and without expending a great deal of time from one type or size of bottle or container to another type or size of bottle or container and/or from one type of label or equipment to another type of label or equipment, etc., merely by exchanging the labeling units 11.

For the precisely aligned arrangement of the labeling units 11 or its unit axis EA with respect to the rotor 9 and the container standing surfaces there, machine-side centering and coupling units 14 are provided on the bottom of a machine table 13 formed by the machine frame 8 or on the periphery thereof. Each unit comprises a carrier or bearing element 15 that is attached to the bottom of the machine table 13 and that has two centering and coupling elements 16 that are offset relative to one another in the circumferential direction of the machine table 13. After the labeling unit has been docked, an unit-side centering and coupling element 17 is placed onto each of these machine-side centering and coupling elements 16. These unit-side centering and coupling elements 17 are each provided at one end of a carrier 18, which, just like the centering and coupling element 17, is also a component of an unit-side centering and docking unit 19. The latter is provided in a suitable manner on an end face 11.1 of the labeling unit and spaced apart via the end face, which [end face] is adjacent to the machine frame 8.

Figure 4:
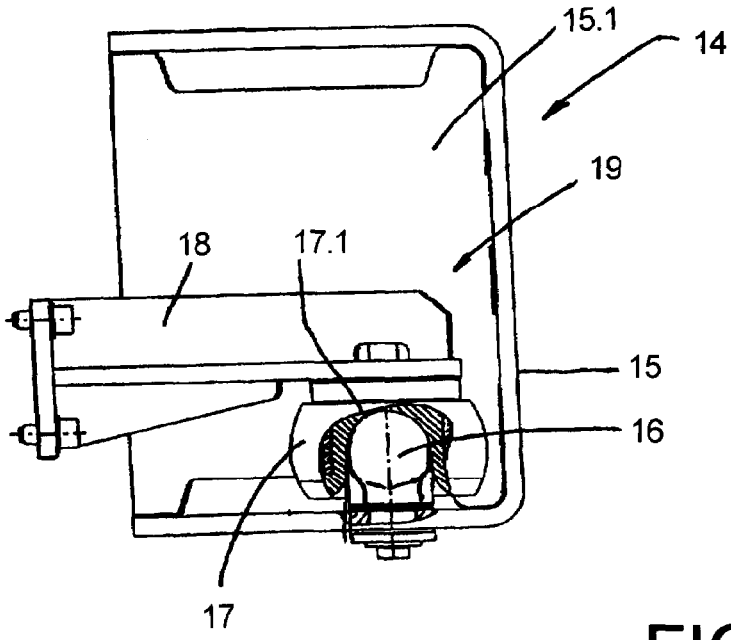
FIG. 4 is a side elevation of the machine-side centering and docking unit, together with a unit-side centering and coupling element, partially in section.

In at least one possible embodiment example, the two machine-side centering and coupling elements 16 are embodied in the shape of spherical heads. The unit-side centering and coupling elements 17 each form a recess 17.1, shown in FIG. 4, that matches the shape of the spherical head and in each of which is received the spherical head of a centering and coupling element 16 when the labeling unit 11 is docked, specifically such that the labeling unit 11 is supported in the area of its end face 11.1 via the two centering and coupling elements 17, each of which are positioned on a centering and coupling element 16 and which are on the machine frame 8 or on the centering and docking unit 14 there. Because of the two machine-side centering and coupling elements 16 and because of the two unit-side centering and coupling elements 17 with their recesses 17.1 matched to the centering and coupling elements 16, after docking to the machine frame 8 the labeling unit 11 has precisely the alignment required for labeling. In at least one possible embodiment of the present application, the alignment of the center axis EA of the labeling unit 11, the required height position, and the rotary position of the labeling unit about an axis that is parallel or substantially parallel to the center axis EA of the labeling unit 11 are established with respect to the machine frame 8.

In the area of the side 11.2 away from the machine frame 8, the labeling unit 11 is supported on the floor 7 with at least one foot 20. Such a foot is provided in the embodiment depicted. As the double-headed arrow C indicates, the feet 20 are height-adjustable. This permits the incline of the labeling unit 11 to be adjusted, specifically by pivoting this unit about the pivot bearing that is formed by the machine-side centering and coupling elements 16 and the unit-side centering and coupling elements 17 and that permits a pivot angle that is adequate for the incline adjustment. The machine-side centering and coupling elements 16 are embodied as spherical heads for this, as stated. Other shapes are also conceivable, for instance the embodiment of the machine-side centering and coupling elements 16 as pins that at their upper, free end, on which the unit-side centering and coupling elements 17 can be placed from above, are like spherical cups or are at least curved about a spatial axis or axis of curvature that is perpendicular to the axis EA of the unit.

Figure 3:
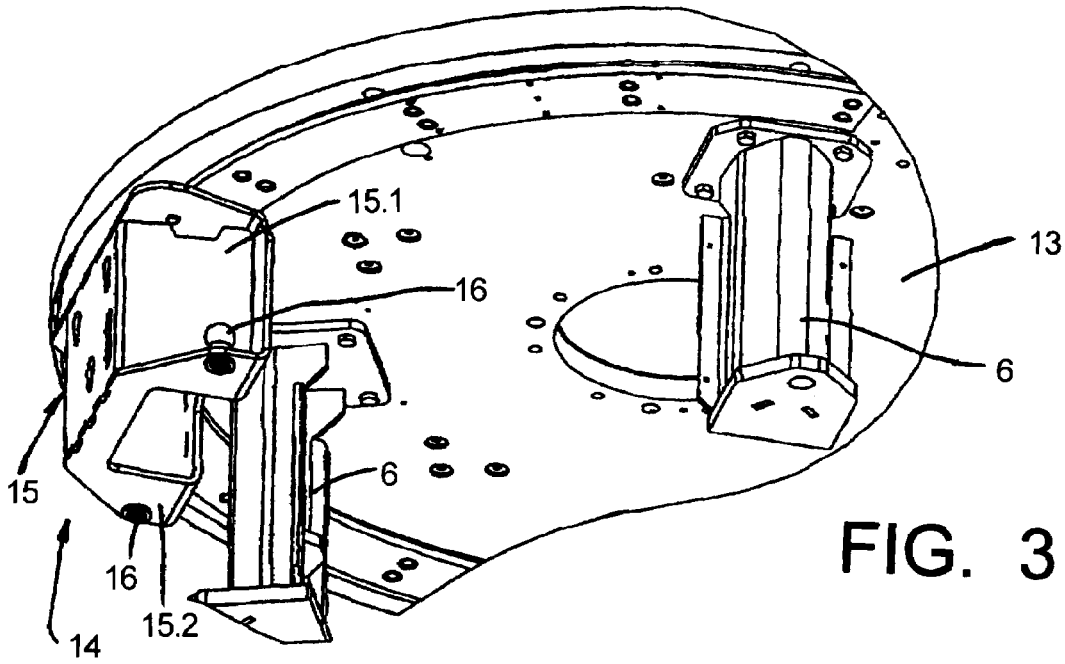
FIG. 3 is a perspective elevation of a view of the bottom of the machine table in the area of a machine-side centering and docking unit for docking to a labeling station.

FIG. 3 shows a view of the bottom of the machine table 13 in the area of a machine-side centering and docking unit 14 for docking to a labeling unit 11, according to at least one possible embodiment of the present application. In order to facilitate docking a labeling unit 11, the bearing element 15 is embodied for instance with two guide surfaces 15.1, of which each is adjacent to a machine-side centering and coupling element 16 and which are likewise arranged offset in the circumferential direction of the rotor 9. Each guide surface 15.1 is formed by a vertical or substantially vertical wall segment. The guide surfaces 15.1 are oriented such that together their planes form an acute or substantially acute angle, i.e., an angle that is smaller than 45° and that opens to the center of the machine frame 8. The two machine-side centering and coupling elements 16 are provided on a panel 15.2 of the bearing element 15 that projects beyond the guide surfaces 15.1. The carrier 18 of the unit-side centering and docking 19 unit is embodied like a mouth so that it reaches over the bearing element 15 in a fork-like manner on the guide surfaces 15.1 when the labeling unit 11 is docked. Thus, during docking the fork-like carrier 18 is guided on the bearing element 15 or on the guide surfaces 15.1 so that it is much easier to dock the labeling unit 11.

Each labeling unit 11 possesses a discrete drive for its functional units. This drive is for instance electrically synchronized with the drive of the rotor 9. Moreover, the functional elements of the labeling unit 11 are provided at least partially adjustable on a frame of this unit.

Figure 5:
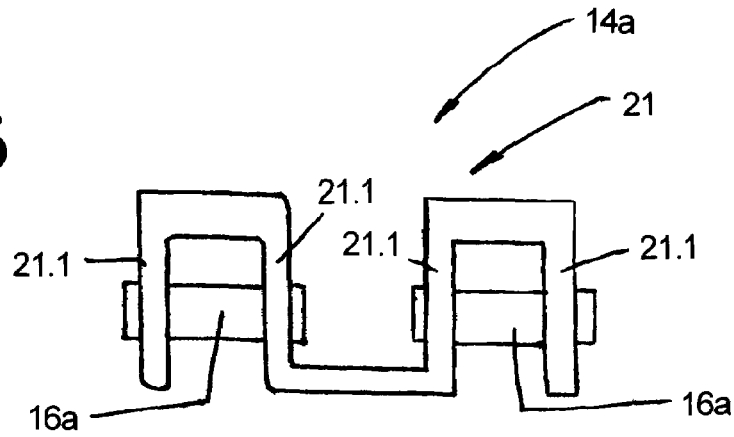
FIG. 5 is a very simplified schematic representation of a top view onto a machine-side centering and docking unit in another possible embodiment of the present application.
Figure 6:
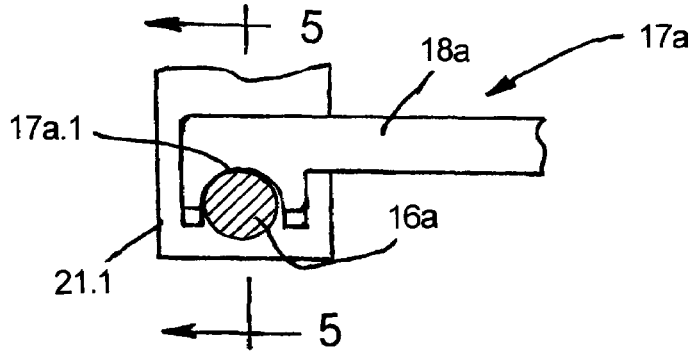
FIG. 6 is a side elevation of a centering and coupling element of the centering and docking unit in FIG. 5.
Figure 7:
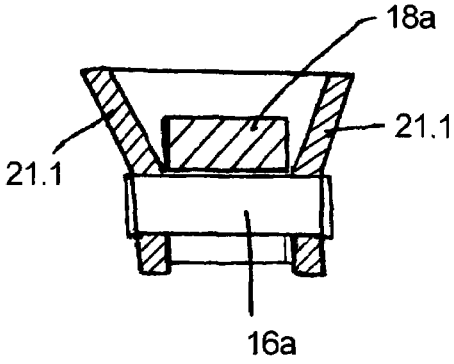
FIG. 7 is a section corresponding to line I-I in FIG. 6.

FIGS. 5-7 provide a simplified depiction of the machine-side centering and docking unit 14*a* and unit-side centering and docking unit 19*a* in another embodiment. The centering and coupling elements 16*a* that in this embodiment correspond to the centering and coupling elements 16 are formed by a bolt or rod that is held at both ends on a wall segment 21.1 of a bearing element 21 that is itself attached in a suitable manner to the periphery of the machine frame 8 or to the bottom of a machine table there. The unit-side centering and coupling elements 17*a* that correspond to the centering and coupling elements 17 are embodied claw-like such that they can each be placed from above onto a centering and coupling element 16*a* with a recess 17*a*.1 that matches the diameter of the centering and coupling element 16*a* so that in this embodiment as well the labeling unit is again supported on its side adjacent to the machine frame 8 with the unit-side centering and coupling elements 17*a* there in a manner that transfers load to the machine-side centering and coupling elements 16*a* or to the centering and docking unit 14*a* that has these elements. The two centering and coupling elements 16*a* are oriented such that they are arranged with their axes coaxial to one another in the horizontal direction, specifically perpendicular or substantially perpendicular to the axis EA, and when the axis EA is oriented radial to the vertical machine axis of the rotor 9, then tangential or nearly tangential to the rotational direction of the rotor 9.

As FIG. 6 indicates, inter alia, the wall segments 21.1 are shaped such that they form a guide opening that narrows downward like a funnel from the top of the centering and docking unit 14*a* to the centering and coupling element 16*a* and that facilitates the introduction of the unit-side centering and coupling elements 17*a*.

At least one possible embodiment of the present application is described herein. It is understood that further changes and modifications are possible without departing from the inventive thought underlying at least one possible embodiment of the present application.

A machine is presented for the equipment of bottles or like containers having at least one transport element on a machine frame for moving the containers on a transport segment, as well as at least one labeling unit arranged on the transport segment, it being provided that the at least one labeling unit on a side adjacent to the machine frame having at least one a unit-side centering and docking unit is supported in a load-transferring manner on at least one machine-side centering and docking unit.

One feature or aspect of an embodiment is believed at the time of the filing of this patent application to possibly reside broadly in a machine for the equipment of bottles 2 or like containers, having at least one transport element 9 on a machine frame 8 for moving said containers 2 on a transport segment, as well as at least one labeling unit 11 arranged on said transport segment, wherein said at least one labeling unit 11 on a side 11.1 adjacent to said machine frame 8 having at least one unit-side centering and docking unit 19, 19*a* is supported in a load-transferring manner on at least one machine-side centering and docking unit 14, 14*a*.

Another feature or aspect of an embodiment is believed at the time of the filing of this patent application to possibly reside broadly in the machine, wherein said at least one labeling unit 11 is additionally arranged with at least one foot 20 on a floor 7, and in that for adjusting the incline of the labeling unit 11 said at least one foot 20 is height-adjustable and the support bearing, formed by said at least one machine-side and unit-side centering and docking unit 14, 14*a*, 19, 19*a*, of said labeling unit 11 on said machine frame 8 is embodied for adjusting the pivot movement, which enables the incline, about a horizontal or approximately horizontal pivot axis.

Yet another feature or aspect of an embodiment is believed at the time of the filing of this patent application to possibly reside broadly in the machine, wherein said at least one machine-side and/or unit-side centering and docking unit 14, 14*a*, 19, 19*a* forms at least one support surface that is convexly curved at least about one axis parallel to the pivot axis and against which said unit-side and/or machine-side centering and docking unit 19, 19*a*, 14, 14*a* is positioned with a countersurface.

Still another feature or aspect of an embodiment is believed at the time of the filing of this patent application to possibly reside broadly in the machine, wherein said support surface is formed by a machine-side centering or coupling element 16, 16*a*.

A further feature or aspect of an embodiment is believed at the time of the filing of this patent application to possibly reside broadly in the machine, wherein said support surface is formed by a unit-side centering and coupling unit 17, 17*a*.

Another feature or aspect of an embodiment is believed at the time of the filing of this patent application to possibly reside broadly in the machine, wherein said at least one unit-side centering and docking unit 19, 19*a* is placed from above onto said at least one support surface 16, 16*a*.

Yet another feature or aspect of an embodiment is believed at the time of the filing of this patent application to possibly reside broadly in the machine, wherein said at least one support surface is partially spherical in shape or is approximately partially spherical in shape.

Still another feature or aspect of an embodiment is believed at the time of the filing of this patent application to possibly reside broadly in the machine, wherein said at least one support surface is formed by the surface of a spherical head.

A further feature or aspect of an embodiment is believed at the time of the filing of this patent application to possibly reside broadly in the machine, wherein said at least one support surface is a cylindrical or approximately cylindrical surface.

Another feature or aspect of an embodiment is believed at the time of the filing of this patent application to possibly reside broadly in the machine, wherein said at least one support surface is formed by at least one centering and coupling element 16, 16*a*.

Yet another feature or aspect of an embodiment is believed at the time of the filing of this patent application to possibly reside broadly in the machine, wherein said centering and docking unit 14, 14*a*, 19, 19*a* has at least two centering and coupling elements 16, 16*a* that are spatially offset from one another.

Still another feature or aspect of an embodiment is believed at the time of the filing of this patent application to possibly reside broadly in the machine, wherein said at least two centering and coupling elements 16, 16*a* are offset from one another in the direction of the pivot axis.

A further feature or aspect of an embodiment is believed at the time of the filing of this patent application to possibly reside broadly in the machine, wherein said transport element is a rotor 5 that can be driven about a vertical machine axis.

Another feature or aspect of an embodiment is believed at the time of the filing of this patent application to possibly reside broadly in the machine, wherein said machine-side centering and docking units 14, 14*a* and/or said machine-side centering and coupling elements 16, 16*a* establish at least the machine-side alignment of said labeling unit 11 in terms of height and/or in terms of the rotary position about an axis parallel to a center axis EA of said labeling unit 11.

Some examples of bottling and container handling systems and components thereof which may possibly be utilized or adapted for use in at least one possible embodiment, may possibly be found in the following U.S. patents: U.S. Pat. No. 6,484,477, entitled "Capping Machine for Capping and Closing Containers, and a Method for Closing Containers;" U.S. Pat. No. 6,474,368, entitled "Beverage Container Filling Machine, and Method for Filling Containers with a Liquid Filling Material in a Beverage Container Filling Machine;" U.S. Pat. No. 6,494,238, entitled "A Plant for Filling Beverage into Beverage Bottles Other Beverage Containers Having Apparatus for Replacing Remaining Air Volume in Filled Beverage Bottles or Other Beverage Containers;" U.S. Pat. No. 6,470,922, entitled "Apparatus for the Recovery of an Inert Gas;" U.S. Pat. No. 6,463,964, entitled "Method of Operating a Plant for Filling Bottles, Cans or the like Beverage Containers with a Beverage, and a Beverage Container Filling Machine;" U.S. Pat. No. 6,834,473, entitled "Bottling Plant and Method of Operating a Bottling Plant and a Bottling Plant with Sections for Stabilizing the Bottled Product;" U.S. Pat. No. 6,484,762, entitled "A Filling System with Post-dripping Prevention;" U.S. Pat. No. 6,668,877, entitled "Filling System for Still Beverages;" U.S. Pat. No. 7,024,841, entitled "Labeling Machine with a Sleeve Mechanism for Preparing and Applying Cylindrical Labels onto Beverage Bottles and Other Beverage Containers in a Beverage Container Filling Plant;" U.S. Pat. No. 6,971,219 entitled "Beverage Bottling Plant for Filling Bottles with a Liquid Beverage Filling Material and a Labeling Station for Labeling Filled Bottles and Other Containers;" U.S. Pat. No. 6,973,767, entitled "Beverage bottling plant and a conveyor arrangement for transporting packages;" U.S. Pat. No. 7,013,624, entitled "Beverage bottling plant for filling bottles with a liquid beverage filling material, a container filling plant container information adding station, such as, a labeling station, configured to add information to containers, such as, bottles and cans, and modules for labeling stations;" U.S. Pat. No. 7,108,025, entitled "Beverage Bottling Plant for Filling Bottles with a Liquid Beverage Filling Material, and a Container Filling Lifting Device for Pressing Containers to Container Filling Machines;" U.S. Pat. No. 7,062,894, entitled "Beverage Bottling Plant for Filling Bottles with a Liquid Beverage Filling Material, and a Container Filling Plant Container Information Adding Station, Such As, a Labeling Station Having a Sleeve Label Cutting Arrangement, Configured to Add Information to Containers, Such As, Bottles and Cans;" U.S. Pat. No. 7,010,900, entitled "Beverage Bottling Plant for Filling Bottles with a Liquid Beverage Filling Material, and a Cleaning Device for Cleaning Bottles in a Beverage Bottling Plant;" U.S. Pat. No. 6,918,417, entitled "A Beverage Bottling Plant for Filling Bottles with a Liquid Beverage Filling Material, and an Easily Cleaned Lifting Device in a Beverage Bottling Plant;" U.S. Pat. No. 7,065,938, entitled "A Beverage Bottling Plant for Filling Bottles with a Liquid Beverage Filling Material, and a Container Filling Plant Container Information Adding Station, Such As, a Labeling Station Having a Gripper Arrangement, Configured to Add Information to Containers, Such As, Bottles and Cans;" U.S. Pat. No. 6,901,720, entitled "A Beverage Bottling Plant for Filling Bottles with a Liquid Beverage Filling Material, and Apparatus for Attaching Carrying Grips to Containers with Filled Bottles;" and U.S. Pat. No. 7,121,062 "Beverage bottling plant for filling bottles with a liquid beverage filling material, having a container handling machine with interchangeable receptacles for the container mouth."

The components disclosed in the various publications, disclosed or incorporated by reference herein, may possibly be used in possible embodiments of the present invention, as well as equivalents thereof.

Some examples of bottling and container handling systems and components thereof which may possibly be utilized or adapted for use in at least one possible embodiment, may possibly be found in the following U.S. patent applications: Ser. No. 10/723,451, filed on Nov. 26, 2003, entitled "Beverage Bottling Plant for Filling Beverage Bottles or Other Beverage Containers with a Liquid Beverage Filling Material and Arrangement for Dividing and Separating of a Stream of Beverage Bottles or Other Beverage Containers;" Ser. No. 10/739,895, filed on Dec. 18, 2003, entitled "Method of Operating a Beverage Container Filling Plant with a Labeling Machine for Labeling Beverage Containers Such as Bottles and Cans, and a Beverage Container Filling Plant with a Labeling Machine for Labeling Beverage Containers Such as Bottles and Cans;" Ser. No. 10/865,240, filed on Jun. 10, 2004, Entitled "A Beverage Bottling Plant for Filling Bottles with a Liquid Beverage Filling Material, a Beverage Container Filling Machine, and a Beverage Container Closing Machine;" Ser. No. 10/883,591, filed on Jul. 1, 2004, entitled "A Beverage Bottling Plant for Filling Bottles with a Liquid Beverage Filling Material Having a Container Filling Plant Container Information Adding Station, Such As, a Labeling Station, Configured to Add Information to Containers, Such As, Bottles and Cans, and Modules for Labeling Stations and a Bottling Plant Having a Mobile Module Carrier;" Ser. No.

10/930,678, filed on Aug. 31, 2004, entitled "A Beverage Bottling Plant for Filling Bottles with a Liquid Beverage Filling Material, a Container Filling Plant Container Filling Machine, and a Filter Apparatus for Filtering a Liquid Beverage;" Ser. No. 10/931,817, filed on Sep. 1, 2004, entitled "A Beverage Bottling Plant for Filling Bottles with a Liquid Beverage Filling Material, Having an Apparatus for Exchanging Operating Units Disposed at Rotating Container Handling Machines;" Ser. No. 10/954,012, filed on Sep. 29, 2004, Ser. No. 10/952,706, Ser. No. 10/962,183, filed on Oct. 8, 2004, Ser. No. 10/967,016, filed on Oct. 15, 2004, Ser. No. 10/982,706, filed on Nov. 5, 2004, Ser. No. 10/982,694, Ser. No. 10/982,710, Ser. No. 10/984,677, filed on Nov. 9, 2004, Ser. No. 10/985,640, filed on Nov. 10, 2004, Ser. No. 11/004,663, filed on Dec. 3, 2004, Ser. No. 11/009,551, filed on Dec. 10, 2004, Ser. No. 11/012,859, filed on Dec. 15, 2004, Ser. No. 11/014,673, filed on Dec. 16, 2004, Ser. No. 11/016,364, filed on Dec. 17, 2004, and Ser. No. 11/016,363, The purpose of the statements about the technical field is generally to enable the Patent and Trademark Office and the public to determine quickly, from a cursory inspection, the nature of this patent application. The description of the technical field is believed, at the time of the filing of this patent application, to adequately describe the technical field of this patent application. However, the description of the technical field may not be completely applicable to the claims as originally filed in this patent application, as amended during prosecution of this patent application, and as ultimately allowed in any patent issuing from this patent application. Therefore, any statements made relating to the technical field are not intended to limit the claims in any manner and should not be interpreted as limiting the claims in any manner.

Some examples of bottling systems, which may be used or adapted for use in at least one possible embodiment of the present may be found in the following U.S. patents assigned to the Assignee herein, namely: U.S. Pat. No. 4,911,285; U.S. Pat. No. 4,944,830; U.S. Pat. No. 4,950,350; U.S. Pat. No. 4,976,803; U.S. Pat. No. 4,981,547; U.S. Pat. No. 5,004,518; U.S. Pat. No. 5,017,261; U.S. Pat. No. 5,062,917; U.S. Pat. No. 5,062,918; U.S. Pat. No. 5,075,123; U.S. Pat. No. 5,078,826; U.S. Pat. No. 5,087,317; U.S. Pat. No. 5,110,402; U.S. Pat. No. 5,129,984; U.S. Pat. No. 5,167,755; U.S. Pat. No. 5,174,851; U.S. Pat. No. 5,185,053; U.S. Pat. No. 5,217,538; U.S. Pat. No. 5,227,005; U.S. Pat. No. 5,413,153; U.S. Pat. No. 5,558,138; U.S. Pat. No. 5,634,500; U.S. Pat. No. 5,713,403; U.S. Pat. No. 6,276,113; U.S. Pat. No. 6,213,169; U.S. Pat. No. 6,189,578; U.S. Pat. No. 6,192,946; U.S. Pat. No. 6,374,575; U.S. Pat. No. 6,365,054; U.S. Pat. No. 6,619,016; U.S. Pat. No. 6,474,368; U.S. Pat. No. 6,494,238; U.S. Pat. No. 6,470,922; and U.S. Pat. No. 6,463,964.

The appended drawings in their entirety, including all dimensions, proportions and/or shapes in at least one embodiment of the invention, are accurate and are hereby included by reference into this specification.

Some examples of labeling machines which may possibly be utilized in at least one possible embodiment may possibly be found in the following U.S. patents: U.S. Pat. No. 6,634,400, entitled "Labeling machine;" U.S. Pat. No. 6,561,246, entitled "Labeling machine capable of precise attachment of a label to different sizes of containers;" U.S. Pat. No. 6,550,512, entitled "Labeling machine capable of preventing erroneous attachment of labels on containers;" U.S. Pat. No. 6,543,514, entitled "In-line continuous feed sleeve labeling machine and method;" U.S. Pat. No. 6,378,587, entitled "Cylindrical container labeling machine;" U.S. Pat. No. 6,328,086, entitled "Labeling machine;" U.S. Pat. No. 6,315,021, entitled "Labeling machine;" U.S. Pat. No. 6,263,940, entitled "In-line continuous feed sleeve labeling machine and method;" U.S. Pat. No. 6,199,614, entitled "High speed labeling machine having a constant tension driving system;" U.S. Pat. No. 6,167,935, entitled "Labeling machine; U.S. Pat. No. 6,066,223, entitled "Labeling machine and method; U.S. Pat. No. 6,050,319, entitled "Non-round container labeling machine and method;" and U.S. Pat. No. 6,045,616, entitled "Adhesive station and labeling machine."

The background information is believed, at the time of the filing of this patent application, to adequately provide background information for this patent application. However, the background information may not be completely applicable to the claims as originally filed in this patent application, as amended during prosecution of this patent application, and as ultimately allowed in any patent issuing from this patent application. Therefore, any statements made relating to the background information are not intended to limit the claims in any manner and should not be interpreted as limiting the claims in any manner.

Some examples of control systems which measure operating parameters and learn therefrom that may possibly be utilized or possibly adapted for use in at least one possible embodiment of the present application may possibly be found in the following U.S. patents: U.S. Pat. No. 4,655,188 issued to Tomisawa et al. on Apr. 7, 1987; U.S. Pat. No. 5,191,272 issued to Torii et al. on Mar. 2, 1993; U.S. Pat. No. 5,223,820, issued to Sutterlin et al. on Jun. 29, 1993; and U.S. Pat. No. 5,770,934 issued to Theile on Jun. 23, 1998.

All, or substantially all, of the components and methods of the various embodiments may be used with at least one embodiment or all of the embodiments, if more than one embodiment is described herein.

The purpose of the statements about the object or objects is generally to enable the Patent and Trademark Office and the public to determine quickly, from a cursory inspection, the nature of this patent application. The description of the object or objects is believed, at the time of the filing of this patent application, to adequately describe the object or objects of this patent application. However, the description of the object or objects may not be completely applicable to the claims as originally filed in this patent application, as amended during prosecution of this patent application, and as ultimately allowed in any patent issuing from this patent application. Therefore, any statements made relating to the object or objects are not intended to limit the claims in any manner and should not be interpreted as limiting the claims in any manner.

All of the patents, patent applications and publications recited herein, and in the Declaration attached hereto, are hereby incorporated by reference as if set forth in their entirety herein.

The summary is believed, at the time of the filing of this patent application, to adequately summarize this patent application. However, portions or all of the information contained in the summary may not be completely applicable to the claims as originally filed in this patent application, as amended during prosecution of this patent application, and as ultimately allowed in any patent issuing from this patent application. Therefore, any statements made relating to the summary are not intended to limit the claims in any manner and should not be interpreted as limiting the claims in any manner.

It will be understood that the examples of patents, published patent applications, and other documents which are included in this application and which are referred to in paragraphs which state "Some examples of . . . which may possibly be used in at least one possible embodiment of the present application . . . " may possibly not be used or useable in any one or more embodiments of the application.

The sentence immediately above relates to patents, published patent applications and other documents either incorporated by reference or not incorporated by reference.

The corresponding foreign and international patent publication applications, namely, Federal Republic of Germany Patent Application No. 20 2006 002 729.7, filed on Feb. 21, 2006, having inventors Klaus KRÄMER and Martin SCHACH, and DE-OS 20 2006 002 729.7 and DE-PS 20 2006 002 729.7, are hereby incorporated by reference as if set forth in their entirety herein for the purpose of correcting and explaining any possible misinterpretations of the English translation thereof. In addition, the published equivalents of the above corresponding foreign and international patent publication applications, and other equivalents or corresponding applications, if any, in corresponding cases in the Federal Republic of Germany and elsewhere, and the references and documents cited in any of the documents cited herein, such as the patents, patent applications and publications, are hereby incorporated by reference as if set forth in their entirety herein.

All of the references and documents, cited in any of the documents cited herein, are hereby incorporated by reference as if set forth in their entirety herein. All of the documents cited herein, referred to in the immediately preceding sentence, include all of the patents, patent applications and publications cited anywhere in the present application.

U.S. patent application Ser. No. 11/676,757, filed on Feb. 20, 2007, having inventor Klaus KRÄMER, corresponding Federal Republic of Germany Patent Application No. 10 2006 007 950.7, Attorney Docket No. NHL-HOL-157 US, and title "BEVERAGE BOTTLING PLANT FOR FILLING BOTTLES WITH A LIQUID BEVERAGE FILLING MATERIAL HAVING AN INFORMATION ADDING STATION" is hereby incorporated by reference as if set forth in its entirety herein.

The description of the embodiment or embodiments is believed, at the time of the filing of this patent application, to adequately describe the embodiment or embodiments of this patent application. However, portions of the description of the embodiment or embodiments may not be completely applicable to the claims as originally filed in this patent application, as amended during prosecution of this patent application, and as ultimately allowed in any patent issuing from this patent application. Therefore, any statements made relating to the embodiment or embodiments are not intended to limit the claims in any manner and should not be interpreted as limiting the claims in any manner.

The details in the patents, patent applications and publications may be considered to be incorporable, at applicant's option, into the claims during prosecution as further limitations in the claims to patentably distinguish any amended claims from any applied prior art.

The purpose of the title of this patent application is generally to enable the Patent and Trademark Office and the public to determine quickly, from a cursory inspection, the nature of this patent application. The title is believed, at the time of the filing of this patent application, to adequately reflect the general nature of this patent application. However, the title may not be completely applicable to the technical field, the object or objects, the summary, the description of the embodiment or embodiments, and the claims as originally filed in this patent application, as amended during prosecution of this patent application, and as ultimately allowed in any patent issuing from this patent application. Therefore, the title is not intended to limit the claims in any manner and should not be interpreted as limiting the claims in any manner.

The abstract of the disclosure is submitted herewith as required by 37 C.F.R. §1.72(b). As stated in 37 C.F.R. §1.72 (b):

> A brief abstract of the technical disclosure in the specification must commence on a separate sheet, preferably following the claims, under the heading "Abstract of the Disclosure." The purpose of the abstract is to enable the Patent and Trademark Office and the public generally to determine quickly from a cursory inspection the nature and gist of the technical disclosure. The abstract shall not be used for interpreting the scope of the claims.

Therefore, any statements made relating to the abstract are not intended to limit the claims in any manner and should not be interpreted as limiting the claims in any manner.

The embodiments of the invention described herein above in the context of the preferred embodiments are not to be taken as limiting the embodiments of the invention to all of the provided details thereof, since modifications and variations thereof may be made without departing from the spirit and scope of the embodiments of the invention.

AT LEAST PARTIAL NOMENCLATURE:

| | |
|---|---|
| 1 | Labeling machine |
| 2 | Bottle |
| 3 | Conveyor |
| 4 | Container inlet |
| 4.1 | Inlet star |
| 5 | Container outlet |
| 5.1 | Outlet start |
| 6 | Foot of machine frame |
| 7 | Base or floor |
| 8 | Machine frame |
| 9 | Rotor |
| 10 | Stamp |
| 11 | Labeling unit |
| 11.1, 11.2 | Side of labeling unit 11 |
| 12 | Label |
| 13 | Machine table |
| 14, 14a | Machine-side centering and docking unit |
| 15 | Bearing element |
| 15.1 | Guide surface |
| 15.2 | Plate or panel |
| 16, 16a | Machine-side centering and coupling element |
| 17, 17a | Unit-side centering and coupling element |
| 17.1, 17a.1 | Opening or recess |
| 18, 18a | Carrier or bearing element for the unit-side centering and coupling element |
| 19, 19a | Unit-side centering and docking unit |
| 20 | Height-adjustable foot |
| 21 | Bearing element of machine-side centering and docking unit 14a |
| 21.1 | Wall segment of bearing element 21 |
| A | Direction of transport of bottles 2 |
| B | Circumferential direction of rotor 9 |
| C | Height adjustment of labeling unit |
| EA | Center axis of labeling unit 11 |

What is claimed is:

1. A beverage bottling plant for filling beverage bottles with liquid beverage material, said beverage bottling plant comprising:

a plurality of rotary machines comprising at least a rotary beverage bottle filling machine, a rotary beverage bottle closing machine, and a rotary beverage bottle information adding machine;

a first conveyor arrangement being configured and disposed to convey beverage bottles to be filled to said beverage bottle filling machine;

said beverage bottle filling machine being configured and disposed to fill beverage bottles with liquid beverage material;

said beverage bottle filling machine comprising:

a rotor;

a rotatable vertical machine column;

said rotor being connected to said vertical machine column to permit rotation of said rotor about said vertical machine column;

a plurality of beverage bottle filling elements for filling beverage bottles with liquid beverage material being disposed on the periphery of said rotor;

each of said plurality of beverage bottle filling elements comprising a container carrier being configured and disposed to receive and hold beverage bottles to be filled;

each of said plurality of beverage bottle filling elements being configured and disposed to dispense liquid beverage material into beverage bottles to be filled;

at least one liquid reservoir being configured to hold a supply of liquid beverage material;

at least one supply line being configured and disposed to connect said at least one liquid reservoir to said beverage bottle filling machine to supply liquid beverage material to said beverage bottle filling machine;

a first star wheel structure being configured and disposed to move beverage bottles into said beverage bottle filling machine; and a second star wheel structure being configured and disposed to move beverage bottles out of said beverage bottle filling machine;

a second conveyor arrangement being configured and disposed to convey filled beverage bottles from said beverage bottle filling machine to said beverage bottle closing machine;

said beverage bottle closing machine being configured and disposed to close tops of filled beverage bottles;

said beverage bottle closing machine comprising:

a rotor;

a rotatable vertical machine column;

said rotor being connected to said vertical machine column to permit rotation of said rotor about said vertical machine column;

a plurality of closing devices being disposed on the periphery of said rotor;

each of said plurality of closing devices being configured and disposed to place closures on filled beverage bottles;

each of said plurality of closing devices comprising a container carrier being configured and disposed to receive and hold filled beverage bottles;

a first star wheel structure being configured and disposed to move filled beverage bottles into said beverage bottle closing machine; and a second star wheel structure being configured and disposed to move filled, closed beverage bottles out of said beverage bottle closing machine;

a third conveyor arrangement being configured and disposed to convey filled, closed beverage bottles from said beverage bottle closing machine to said beverage bottle information adding machine;

said beverage bottle information adding machine being configured and disposed to add information to filled, closed beverage bottles;

said beverage bottle information adding machine comprising:

a rotor;

a rotatable vertical machine column;

said rotor being connected to said vertical machine column to permit rotation of said rotor about said vertical machine column;

a plurality of beverage bottle support structures being disposed on the periphery of said rotor;

said beverage bottle support structures being configured to support and hold filled, closed beverage bottles;

a first star wheel structure being configured and disposed to move filled, closed beverage bottles into said beverage bottle information adding machine;

a second star wheel structure being configured and disposed to move beverage bottles out of said beverage bottle information adding machine;

a stationary frame portion disposed adjacent the periphery of said rotor;

at least one beverage bottle information adding device being configured and disposed to add information to a beverage bottle;

said at least one beverage bottle information adding device being disposed to the side of said rotor outside the perimeter of said rotor;

said stationary frame portion comprising at least one centering and docking unit;

said at least one beverage bottle information adding device comprising at least one centering and docking unit;

said at least one centering and docking unit of said stationary frame portion being configured and disposed to be detachably connected to said at least one centering and docking unit of said at least one beverage bottle information adding device to support said at least beverage bottle information adding device in a load-transferring manner.

2. The beverage bottling plant according to claim 1, wherein said at least one information adding unit is additionally arranged with at least one foot on a floor, and in that for adjusting the incline of the information adding unit said at least one foot is height-adjustable and the support bearing, formed by said at least one machine-side and unit-side centering and docking unit of said information adding unit on said machine frame is embodied for adjusting the pivot movement, which enables the incline, about a horizontal or approximately horizontal pivot axis.

3. The beverage bottling plant according to claim 2, wherein said at least one machine-side and/or unit-side centering and docking unit forms at least one support surface that is convexly curved at least about one axis parallel to the pivot axis and against which said unit-side and/or machine-side centering and docking unit is positioned with a countersurface.

4. The beverage bottling plant according to claim 3, wherein said support surface is formed by a machine-side centering or coupling element.

5. The beverage bottling plant according to claim 4, wherein said support surface is formed by a unit-side centering and coupling unit.

6. The beverage bottling plant according to claim 5, wherein said at least one unit-side centering and docking unit is placed from above onto said at least one support surface.

7. The beverage bottling plant according to claim 6, wherein said at least one support surface is partially spherical in shape or is approximately partially spherical in shape.

8. The beverage bottling plant according to claim 7, wherein:

said at least one support surface is formed by the surface of a spherical head; and said at least one support surface is a cylindrical or approximately cylindrical surface.

9. The beverage bottling plant according to claim 8, wherein:

said at least one support surface is formed by at least one centering and coupling element; and said centering and docking unit has at least two centering and coupling elements that are spatially offset from one another.

10. The beverage bottling plant according to claim 9, wherein:

said at least two centering and coupling elements are offset from one another in the direction of the pivot axis;

said transport element is a rotor that can be driven about a vertical machine axis; and said machine-side centering and docking units and/or said machine-side centering and coupling elements establish at least the machine-side alignment of said information adding unit in terms of height and/or in terms of the rotary position about an axis parallel to a center axis of said information adding unit.

11. A container filling plant for filling containers, said container filling plant comprising:

a plurality of rotary machines comprising at least a rotary container filling machine, a rotary container closing machine, and a rotary container information adding machine;

a first conveyor arrangement being configured and disposed to convey containers to be filled to said container filling machine;

said container filling machine being configured and disposed to fill containers;

said container filling machine comprising:

a rotor;

a rotatable vertical machine column;

said rotor being connected to said vertical machine column to permit rotation of said rotor about said vertical machine column;

a plurality of container filling elements for filling containers being disposed on the periphery of said rotor;

each of said plurality of container filling elements comprising a container carrier being configured and disposed to receive and hold containers to be filled;

a first star wheel structure being configured and disposed to move containers into said container filling machine; and a second star wheel structure being configured and disposed to move containers out of said container filling machine;

a second conveyor arrangement being configured and disposed to convey filled containers from said container filling machine to said container closing machine;

said container closing machine being configured and disposed to close tops of filled containers;

said container closing machine comprising:

a rotor;

a rotatable vertical machine column;

said rotor being connected to said vertical machine column to permit rotation of said rotor about said vertical machine column;

a plurality of closing devices being disposed on the periphery of said rotor;

each of said plurality of closing devices being configured and disposed to place closures on filled containers;

each of said plurality of closing devices comprising a container carrier being configured and disposed to receive and hold filled containers;

a first star wheel structure being configured and disposed to move filled containers into said container closing machine; and a second star wheel structure being configured and disposed to move filled, closed containers out of said container closing machine;

a third conveyor arrangement being configured and disposed to convey filled, closed containers from said container closing machine to said container information adding machine;

said container information adding machine being configured and disposed to add information to filled, closed containers;

said container information adding machine comprising:

a rotor;

a rotatable vertical machine column;

said rotor being connected to said vertical machine column to permit rotation of said rotor about said vertical machine column;

a plurality of container support structures being disposed on the periphery of said rotor;

said container support structures being configured to support and hold filled, closed containers;

a first star wheel structure being configured and disposed to move filled, closed containers into said container information adding machine;

a second star wheel structure being configured and disposed to move containers out of said container information adding machine;

a stationary frame portion disposed adjacent the periphery of said rotor;

at least one container information adding device being configured and disposed to add information to a container;

said at least one container information adding device being disposed to the side of said rotor outside the perimeter of said rotor;

said stationary frame portion comprising at least one centering and docking unit;

said at least one container information adding device comprising at least one centering and docking unit;

said at least one centering and docking unit of said stationary frame portion being configured and disposed to be detachably connected to said at least one centering and docking unit of said at least one container information adding device to support said at least container information adding device in a load-transferring manner.

12. The container filling plant according to claim 11, wherein said at least one information adding unit is additionally arranged with at least one foot on a floor, and in that for adjusting the incline of the information adding unit said at least one foot is height-adjustable and the support bearing, formed by said at least one machine-side and unit-side centering and docking unit of said information adding unit on said machine frame is embodied for adjusting the pivot movement, which enables the incline, about a horizontal or approximately horizontal pivot axis.

13. The container filling plant according to claim 12, wherein said at least one machine-side and/or unit-side centering and docking unit forms at least one support surface that is convexly curved at least about one axis parallel to the pivot axis and against which said unit-side and/or machine-side centering and docking unit is positioned with a countersurface.

14. The container filling plant according to claim 13, wherein said support surface is formed by a machine-side centering or coupling element.

15. The container filling plant according to claim 14, wherein said support surface is formed by a unit-side centering and coupling unit.

16. The container filling plant according to claim 15, wherein said at least one unit-side centering and docking unit is placed from above onto said at least one support surface.

17. The container filling plant according to claim 16, wherein said at least one support surface is partially spherical in shape or is approximately partially spherical in shape.

18. The container filling plant according to claim 17, wherein:

said at least one support surface is formed by the surface of a spherical head; and said at least one support surface is a cylindrical or approximately cylindrical surface.

19. The container filling plant according to claim 18, wherein:

said at least one support surface is formed by at least one centering and coupling element; and said centering and docking unit has at least two centering and coupling elements that are spatially offset from one another.

20. The container filling plant according to claim 19, wherein:

said at least two centering and coupling elements are offset from one another in the direction of the pivot axis;

said transport element is a rotor that can be driven about a vertical machine axis; and said machine-side centering and docking units and/or said machine-side centering and coupling elements establish at least the machine-side alignment of said information adding unit in terms of height and/or in terms of the rotary position about an axis parallel to a center axis of said information adding unit.

* * * * *